US008430070B2

(12) United States Patent
Rebello

(10) Patent No.: US 8,430,070 B2
(45) Date of Patent: Apr. 30, 2013

(54) PISTON WITH CROWN COOLING NOZZLE

(75) Inventor: Jose Ricardo Rebello, Ann Arbor, MI (US)

(73) Assignee: Federal-Mogul Corporation, Southfield, MI (US)

( * ) Notice: Subject to any disclaimer, the term of this patent is extended or adjusted under 35 U.S.C. 154(b) by 434 days.

(21) Appl. No.: 12/757,391

(22) Filed: Apr. 9, 2010

(65) Prior Publication Data

US 2010/0258064 A1 Oct. 14, 2010

Related U.S. Application Data

(60) Provisional application No. 61/168,291, filed on Apr. 10, 2009.

(51) Int. Cl.
*F01P 1/04* (2006.01)

(52) U.S. Cl.
USPC ..... 123/41.35; 123/196 R; 92/181 R

(58) Field of Classification Search ..... 123/41.34, 123/41.35, 193.6, 193.4, 193.1, 196 R, 196 AB; 92/208, 214, 222, 231, 260, 172, 174, 181 R, 92/184, 186, 189
See application file for complete search history.

(56) References Cited

U.S. PATENT DOCUMENTS

| | | | | | |
|---|---|---|---|---|---|
| 2,304,891 | A | * | 12/1942 | Dickson | 123/41.35 |
| 2,967,516 | A | | 1/1961 | Stumpfig | |
| 3,613,521 | A | * | 10/1971 | Itano | 92/186 |
| 4,175,502 | A | | 11/1979 | Moebus | |
| 4,377,967 | A | | 3/1983 | Pelizzoni | |
| 4,517,930 | A | * | 5/1985 | Nakano et al. | 123/41.31 |
| 4,581,983 | A | * | 4/1986 | Moebus | 92/186 |
| 4,587,932 | A | * | 5/1986 | Moebus | 123/41.35 |
| 4,662,319 | A | * | 5/1987 | Ayoul | 123/41.35 |
| 5,860,395 | A | | 1/1999 | Klotz et al. | |
| 5,906,182 | A | * | 5/1999 | Blase et al. | 123/193.6 |
| 6,223,701 | B1 | * | 5/2001 | Kruse | 123/41.35 |
| 6,477,941 | B1 | * | 11/2002 | Zhu et al. | 92/186 |
| 2009/0007776 | A1 | | 1/2009 | Benz et al. | |

FOREIGN PATENT DOCUMENTS

| | | | |
|---|---|---|---|
| JP | 04-066343 | U | 6/1992 |
| JP | 08-061060 | A | 3/1996 |
| JP | 11-132101 | A | 5/1999 |

* cited by examiner

*Primary Examiner* — Noah Kamen
*Assistant Examiner* — Hung Q Nguyen
(74) *Attorney, Agent, or Firm* — Robert L. Stearns; Dickinson Wright, PLLC

(57) ABSTRACT

A piston (10, 10') includes a piston body (12, 12') having an upper crown portion (16, 16') with an upper combustion dome (18, 18') against which combustion forces act. The underside of the upper combustion dome (18, 18') comprises an under-crown region (60, 60'). The piston body (12, 12') also includes a lower crown portion (26, 26') with a pair of pin bosses (36, 38) spaced apart for pivotally adjoining a connecting rod. An outer oil gallery (31, 31') is formed as an inclusion between the upper (16, 16') and lower (26, 26') crown portions. The outer oil gallery (31, 31') has an oil inlet (50, 50') and an oil outlet (52, 52'). A tubular cooling nozzle (54, 54') is affixed in fluid communication with the oil outlet (52, 52') and extends toward the under-crown region (60, 60') where oil is discharged during reciprocation of the piston (16, 16'). Cooling oil from the outer oil gallery (33) is channeled by the cooling nozzle (54, 54') to the under-crown region (60, 60') providing supplemental cooling in a passively actuated system.

20 Claims, 4 Drawing Sheets

PISTON WITH CROWN COOLING NOZZLE

CROSS REFERENCE TO RELATED APPLICATIONS

This application claims priority to Provisional Patent Application No. 61/168,291 filed Apr. 10, 2009, the entire disclosure of which is hereby incorporated by reference and relied upon.

BACKGROUND OF THE INVENTION

1. Field of the Invention

This invention relates generally to pistons for internal combustion engines, and more particularly to diesel pistons having internal oil cooling features.

2. Related Art

Hollow piston constructions for diesel engines are known for providing enhanced cooling capabilities, which in turn often yield improvements in exhaust emissions and extended service life. In these applications, the normal engine lubricating oil is used to help cool (convectively) the hot head, or specifically the under-crown region, as well as the outer ring belt region of the piston. In some hollow piston configurations, a single outer cooling gallery near the ring belt region may be used, or a central oil gallery under the crown region, or two galleries paired (dual galleries) in various combinations of open and closed geometries. Dual gallery pistons typically have an annular, radially outer cooling gallery and an open central cooling gallery formed between upper and lower crown portions. The outer and central galleries can either be isolated from one another or arranged in relatively open fluid communication with one another via multiple oil passages extending through intervening ribs. In addition, it is known to provide pin lubrication passages extending from one or both of the galleries to a wrist pin. The lubrication passages can, for example, extend into a wrist pin bore of a pin boss and/or between laterally spaced pin bosses. The outer gallery, whether formed as a single or dual gallery construction, is particularly suited for cooling a ring belt region of the piston, while the central gallery, if present, is particularly suited for cooling a central crown region formed in part by a combustion bowl wall or dome, which is directly exposed to hot combustion gasses.

The combustion dome and underlying central crown region (i.e., under-crown) are exposed to extreme heat in use. Without proper management of heat in this under-crown region, several problems can result. For example, it is possible that carbon build-up on the under-crown will form over time. This carbon build up will further reduce the heat transfer from the combustion bowl leading to higher temperatures on that region. This carbon build up can eventually flake off. Loose carbon flakes can be caught between moving components and cause scratches. Another problem associated with excessive heat build-up in the under-crown region relates to exhaust emissions. If combustion temperatures are not tightly controlled in diesel engines, the combustion process can not be optimally regulated for efficiency and emissions concerns. And further, if the piston temperatures are allowed to rise too high, the lubricating oil can become over-heated and begin to chemically break down prematurely, thus reducing its service life.

Over the years, engine designers have sought to provide sufficient oil flow in the central crown region while at the same time avoiding deterioration of the oil due to over-heating to avoid the aforementioned problems. If an insufficient supply of oil is directed to the under-crown region, or if the oil is allowed to remain in the region for too long, the oil overheats and its cooling and lubrication functions are diminished. As such, an ample flow of cooling oil must be provided in order to properly regulate the temperature of the under-crown region.

There is therefore a need in the art for improved temperature management strategies in piston design, and in particular for the design of diesel pistons, that optimally cools the under-crown region with lubricating oil during use.

SUMMARY OF THE INVENTION

The invention contemplates a piston for an internal combustion engine having an upper crown portion and a lower crown portion. The upper crown portion includes an upper combustion wall against which combustion forces act, along with an under-crown surface formed on the undersurface of the upper combustion wall. The lower crown portion includes at least one pin boss for coupling to a connecting rod. An outer cooling gallery is formed between the upper crown portion and the lower crown portion. An oil inlet communicates directly with the cooling gallery for conducting oil into the outer cooling gallery. An oil outlet is spaced from the inlet and communicates directly with the outer cooling gallery for conducting oil out of the outer cooling gallery. A cooling nozzle is provided communicating directly with the outlet for conducting at least a portion of oil exiting the outer cooling gallery through the outlet toward the under-crown. The cooling nozzle enables oil to be routed or channeled from the outer cooling gallery and sprayed generally toward the under-crown in response to reciprocating motion of the piston when in operation. In addition to enhanced cooling properties, the cooling nozzle is well-suited to provide a sufficient supply of oil to the under-crown so that the oil will not over-heat.

According to another aspect of this invention, a method is provided for cooling a reciprocating piston with oil in an internal combustion engine. The method includes the steps of providing a piston having an upper combustion wall against which combustion forces act, an internal outer oil gallery and an under-crown region directly below the upper combustion wall and generally concentrically disposed relative to the outer cooling gallery. The piston is reciprocated in an internal combustion engine generally along a central reciprocating axis. Simultaneously with the reciprocating step, a flow of cooling oil is directed into the outer oil gallery. Cooling oil inside the outer oil gallery drains from through an outlet. The method further includes the step of channeling the cooling oil drained from the outer oil gallery to the under-crown through a cooling nozzle.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
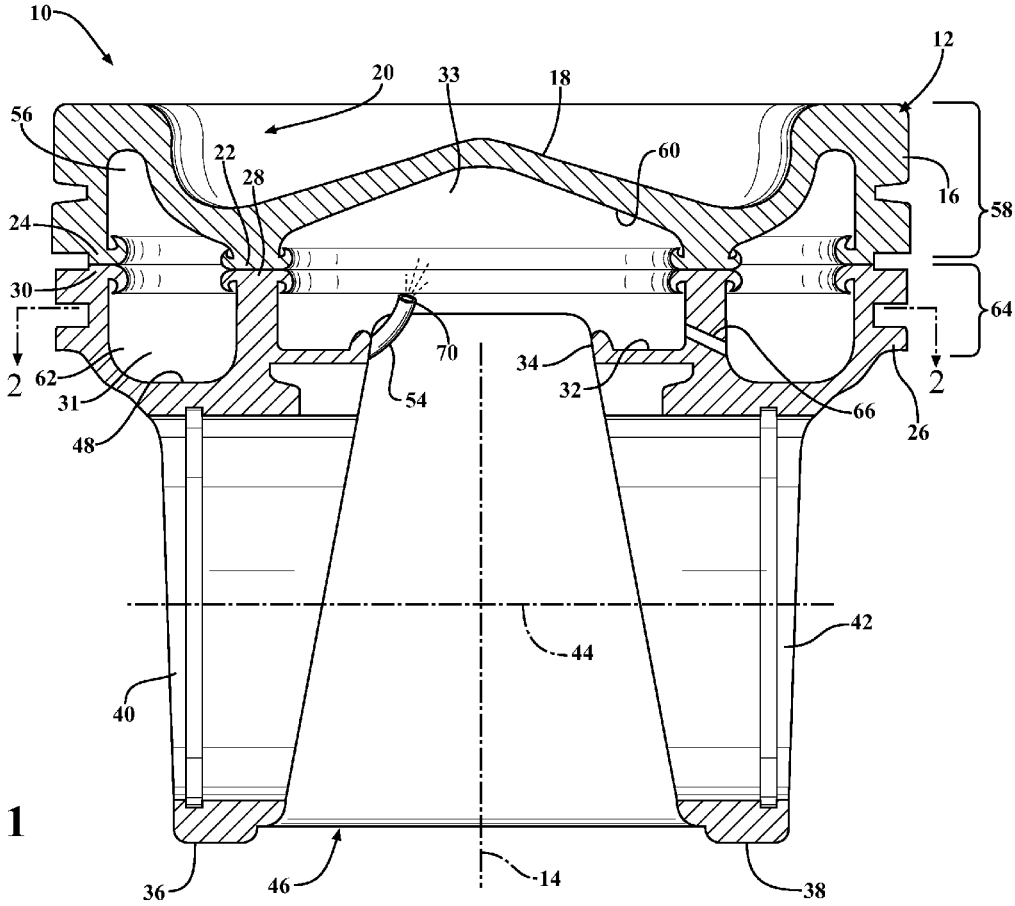
FIG. 1 is a cross-sectional view of a dual gallery piston taken generally through the pin bore axis and constructed in accordance with one embodiment of the invention.

Referring to the figures wherein like numerals indicate like or corresponding parts throughout the several views, FIG. 1 illustrates a dual gallery type diesel piston 10 constructed in accordance with one embodiment of the invention. The piston 10 has a piston body 12 extending along a central axis 14 that generally coincides with the reciprocating path of the piston 10 within a cylinder bore (not shown). The piston body 12 includes an upper crown portion 16 having an upper combustion wall or dome 18, represented here, by way of example and without limitation, as having a recessed combustion bowl 20, against which combustion forces directly act in the cylinder bore, thereby providing a location for extreme heat generation. An under-crown 60 is formed on the opposite side of the upper combustion wall 18 beneath the combustion bowl 20. The upper crown portion 16 is preferably formed as a separate, or loose, piece and then subsequently assembled as part of the piston 10. In its initial, loose-piece state, the upper crown portion 16 has at least one, and shown here a pair, of annular upper ribs 22, 24. These ribs are referred to hereafter as an upper inner rib 22 and upper outer rib 24, and they each depend from the upper combustion wall 18 to respective free ends (in the pre-assembled condition).

The piston body 12 further includes a lower crown portion 26 that is also preferably pre-formed as a component and then subsequently assembled to the upper crown portion 16. The lower crown portion 26 has at least one, and shown here a pair, of annular lower ribs 28, 30. These ribs are referred to hereafter as a lower inner rib 28 and lower outer rib 30, and extends to respective free ends (in the pre-assembled condition) arranged in alignment for fixed abutment with the respective free ends of the upper inner and outer ribs 22, 24 to form and separate an outer cooling gallery 31 from a central crown region, also referred to as a central cooling gallery 33. These opposing ribs can be joined by any suitable means including, for example, friction welding, resistance welding, stir welding, bonding, mechanical interlock, and the like.

The lower crown portion 26, in this example, has an inner gallery floor 32 provided by an annular flange 34 extending radially inwardly from the lower inner rib 28 toward the central reciprocating axis 14. The lower crown portion 26 has an outer gallery floor 48 extending laterally between the lower inner and outer ribs 28, 30. At least one, but normally a pair of pin bosses 36, 38 depend generally from the outer and central galleries 31, 33 to provide wrist pin bores 40, 42 aligned along a pin axis 44 for pivotally connecting a wrist or gudgeon pin (not shown). A space 46 provided between the pin bosses 38, 40 accommodates the small end of a connecting rod (not shown) in the usual manner.

Figure 2:
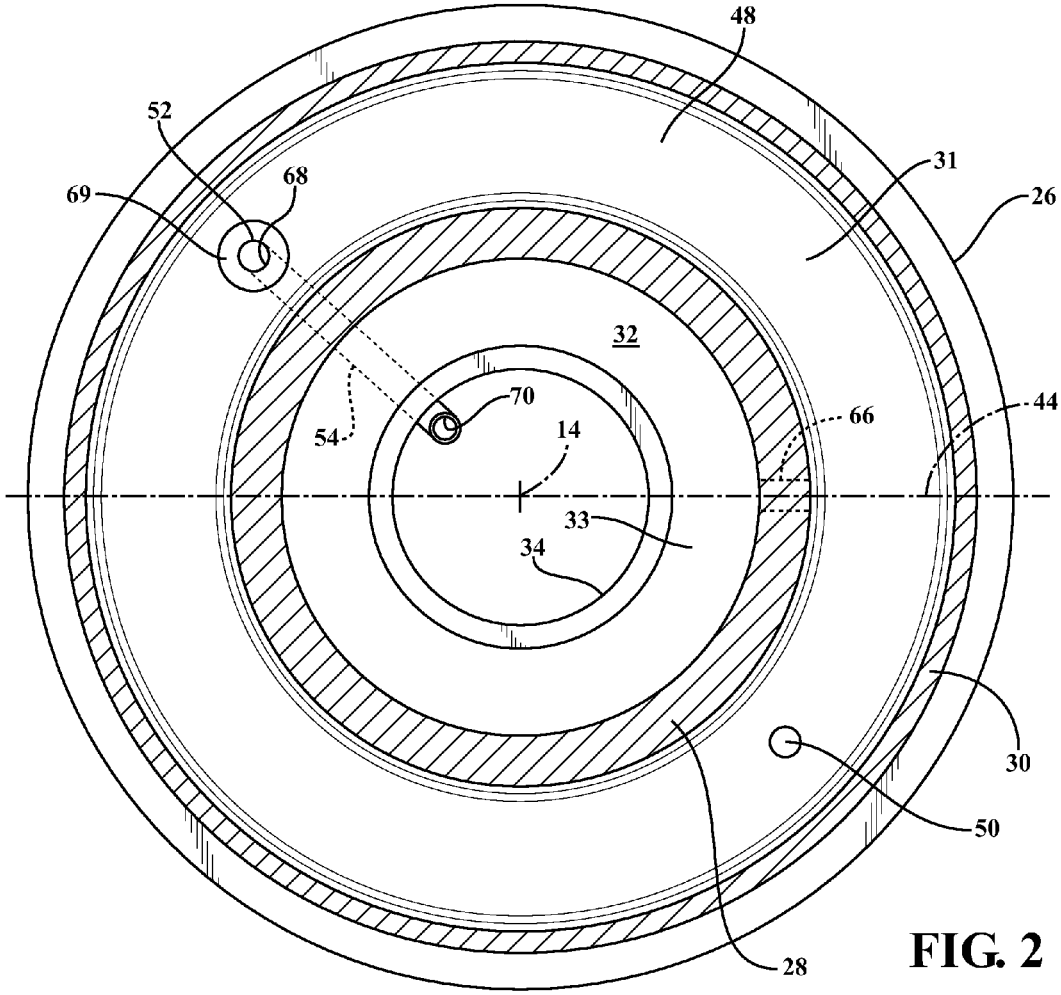
FIG. 2 is a cross-sectional view taken generally along lines 2-2 in FIG. 1.

As shown in FIG. 2, the outer gallery floor 48 has a through opening providing an oil inlet 50 to allow oil to admit oil into the outer gallery 31 by any of the traditional methods. Another through opening provides an oil outlet 52 to allow oil to exit from the outer gallery 31. A cooling nozzle 54 extends from the oil outlet 52 and is routed radially inwardly toward the under-crown 60. The cooling nozzle 54 passively channels oil flowing outwardly from the outer oil gallery 31 to the under-crown 60. More specifically, during upward movement of the piston 10, inertial forces act on the oil contained within the outer gallery 31 which have the effect of pushing the oil toward the floor 48 and out through the oil outlet 52. Naturally, the oil will move freely through the outlet 52 and into the cooling nozzle 54. The forces of a reciprocating piston are sufficiently large enough that the oil will be pushed though the cooling nozzle 54 with relatively high velocity, resulting in a forceful squirt of oil onto the under-crown surface 60 with each upward stroke of the piston 10. Although preferably tubular in shape, the cooling nozzle 54 may be shaped by any suitable device or method, including integral formations in the piston body 12. As such, an improved oil flow is provided beneath the combustion bowl 20 to provide enhanced cooling to the under-crown region 60 without over-heating the oil.

The upper crown portion 16 is represented as having an annular outer oil gallery pocket 56 extending from the inner and outer rib free ends upwardly into an upper ring belt region 58 in this example. However, these particular design details are subject to revision depending upon the particular application or other parameters.

The lower crown portion 26 may be formed in a casting or forging process from steel or other metal, having an annular outer oil gallery pocket 62 extending from the inner and outer rib free ends downwardly into a lower ring belt region 64. Upon attaching the upper crown portion 16 to the lower crown portion 26, the annular outer oil gallery, represented here as a substantially closed outer oil gallery 31, and the open inner or central cooling gallery 33 are formed. The outer oil gallery 31 is bounded by the outer ribs 24, 30 and inner ribs 22, 28 while the central oil gallery 33 is bounded at its outer periphery by the inner ribs 22, 28 and at its upper surface by the dome 18.

In appropriate circumstances, it may be desirable to provide one or more supplemental oil flow passages in the lower ribs 32, 34 and/or through the annular inner ribs 22, 28. For example, as shown in FIGS. 1 and 2, a supplemental oil passage 66 may be formed through the lower inner rib 28 in preferably ascending relation from a lower most portion of the outer oil gallery 31 to a floor of the central oil gallery pocket 33 formed by the flange 34. As the piston reciprocates, the ascending passage(s) 66 allows additional cooling oil to be shaken through from the outer gallery 31 into the central gallery region 33. Through a sloshing effect, oil in the central gallery region 33 will be splashed against the under-crown 60 before it falls though the central opening inside the flange 34 and eventually rejoins the general reserve of lubricating oil in the engine.

To facilitate cooling the piston 10, the respective inlet and outlet oil flow openings 50, 52 may be oriented with respect to one another in any suitable arrangements. FIG. 2 shows these features passing through the floor 48 of the outer oil gallery 31 in diametrically opposed relation to one another, and formed generally 45 degrees offset from the wrist pin axis 44. This is but one example, and it is contemplated that other geometric relationships may provide acceptable performance. In any event, oil from the engine crankcase will flow upwardly into the outer oil gallery 31 through the inlet opening 50, whereupon the oil is circulated about the outer oil gallery 31 and channeled downwardly out of the outer oil gallery 31 through the outlet opening 52 and through the cooling nozzle 54 where it is forcefully squirted against the under-crown 60. If the piston 10 is fitted with the optional oil flow passage 66 or other supplemental outlet feature, oil within the outer gallery 31 that is not channeled through the cooling nozzle 54 will exit through the oil passage 66.

The cooling nozzle 54 preferably has one end 68 attached to the outer gallery floor 48 with a coupling 69. The coupling 69 is in fluid communication with the outlet opening 52. An opposite end 70 of the cooling nozzle 54 extends in somewhat cantilevered fashion toward and/or into the central oil gallery 33. The coupling 69 of the cooling nozzle 54 can be attached using any suitable technique, e.g., snap in, force fit, interlock, threaded attachment, bonding or welding, to name a few. Supplemental attachment of the cooling nozzle 54 along its length to the lower crown portion 26 may be accomplished, if desired, such as by a bracket or clip (not shown). Installation of the cooling nozzle 54 can be accomplished prior to joining the lower crown portion 26 to the upper crown portion 16 or after joining. The cooling nozzle 54 can be constructed from any suitable type of metal or from a high-temperature rated polymeric, plastic material. Lighter weight materials would be favored to reduce the effects of inertia on the cooling nozzle 54, coupling 69 and any bracketry during operation.

The cooling nozzle 54 can be configured as may desired to suit a particular installation or application. The cooling nozzle 54 is shown in FIGS. 1 and 2 bent in a generally U-shape, and having a generally uniform inner diameter. Of course, the length and passage configuration of the cooling nozzle 54 may be re-configured as needed to more effectively spray oil from the outer gallery 31 upwardly onto the under-crown region 60. As such, the oil flowing from the outer gallery 31 is re-circulated to help manage the temperature of the under-crown region 60 without over-heating the oil.

Figure 3:
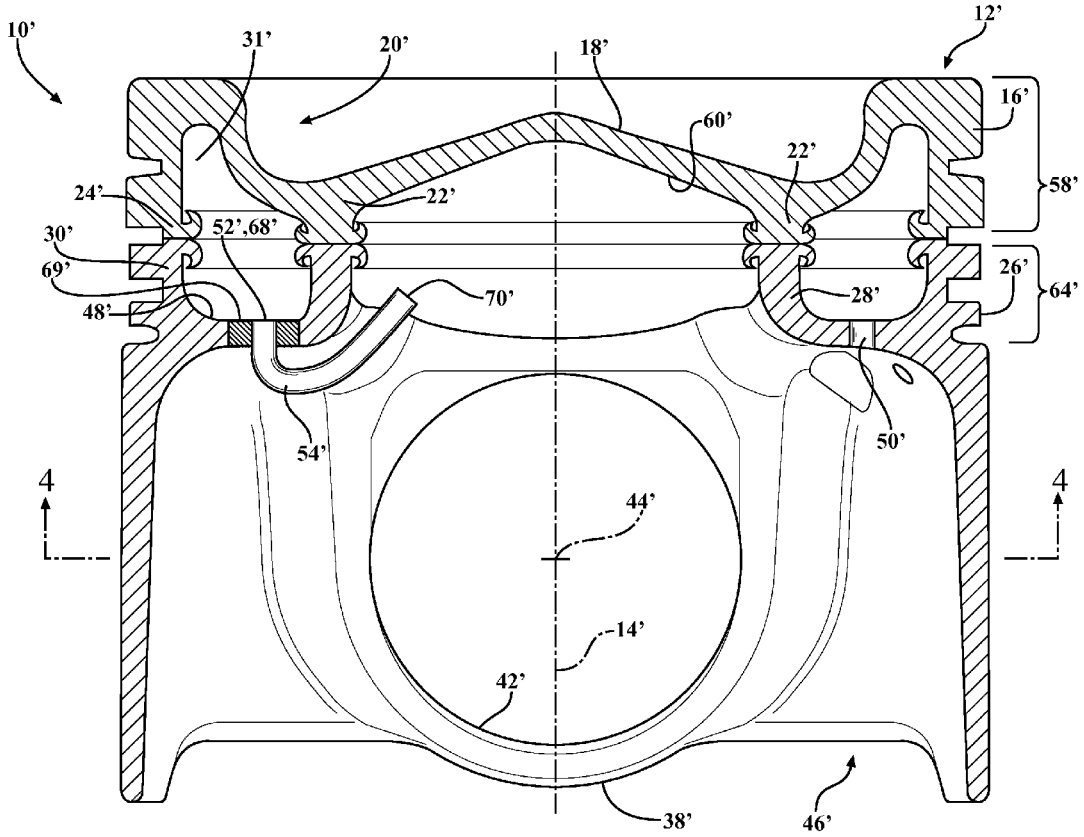
FIG. 3 is a cross-sectional view of an alternative single gallery piston embodiment taken generally perpendicular to the pin bore axis.

FIG. 3 is a cross-sectional view of an alternative single gallery piston embodiment 10' taken generally perpendicular to the pin bore axis 44'. For convenience, in this alternative embodiment, like or corresponding reference numerals are re-used but with prime designations throughout both FIGS. 3 and 4. The reader is directed to the preceding text for a complete description of the components referenced in FIGS. 3 and 4.

Figure 4:
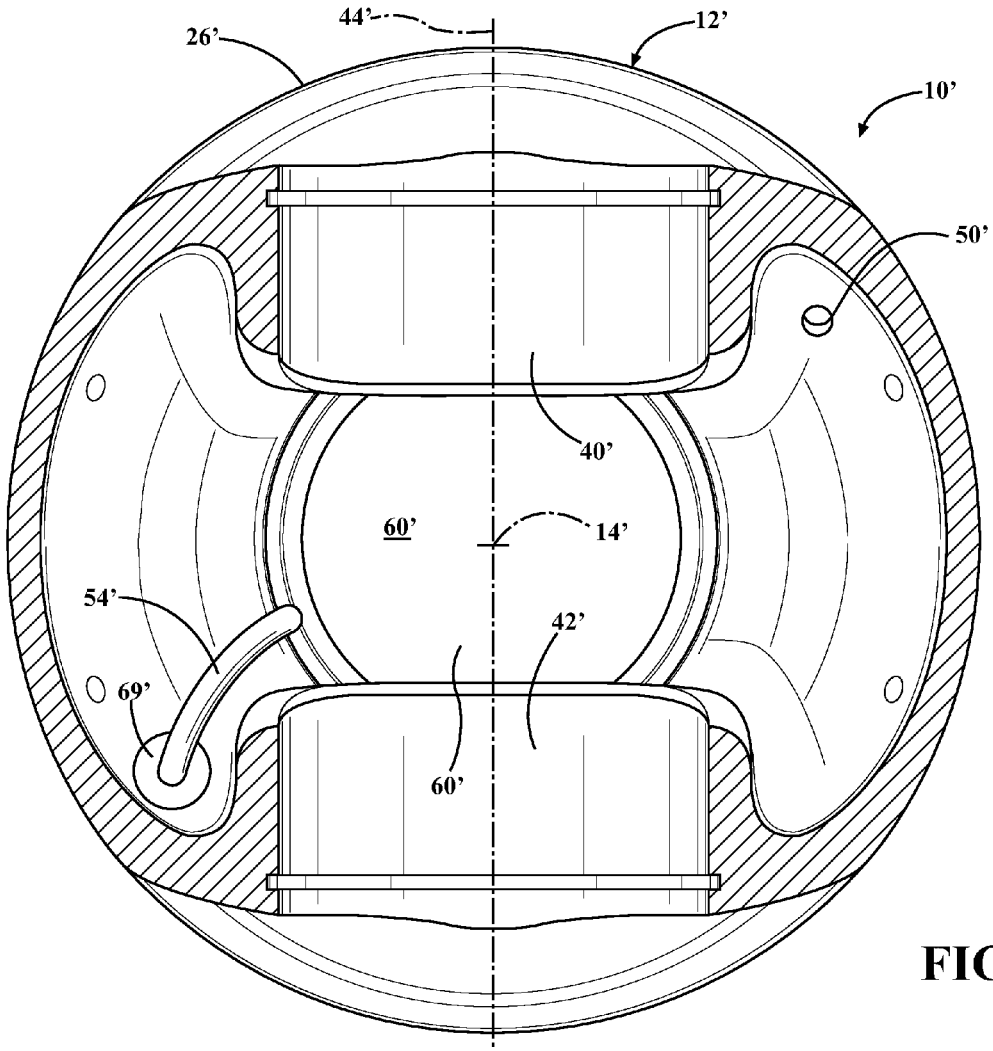
FIG. 4 is a cross-sectional view taken generally along lines 4-4 in FIG. 3.

In this alternative embodiment, the piston 10' does not have a central oil gallery. Therefore, in this application, the cooling nozzle 54' enables an intentional, meaningful and reliable application of cooling oil to the under-crown region 60' which would not otherwise be possible. As in the preceding example, the cooling nozzle 54' is attached at one end 68' to the floor 48' of the outer oil gallery 31' via a coupling 69'. The opposite end 70' of the cooling nozzle 54' is routed inwardly and upwardly toward the under-crown region 60'. FIG. 4 illustrates the manner in which the location of the cooling nozzle 54' is selected to avoid interference with the pin bosses, similar to the first described embodiment. Discharge from the end 70' of the cooling nozzle 54' is preferably along a vector that intersects the central reciprocating axis 14'.

As with the first described example, the cooling nozzle 54' operates as a passive system, automatically channeling oil in direct response to the reciprocating motion of the piston 10'. This results due to inertial forces generated by a reciprocating piston 10' acting on the oil in the outer gallery 31', with inertia fluctuations that result from changes in engine RPM. The faster the piston 10' reciprocates (i.e., at higher RPM), the more oil will be circulated and greater heat transfer is possible.

Obviously, many modifications and variations of the present invention are possible in light of the above teachings. For example, it is contemplated that the piston 10, 10' could be constructed as a closed gallery articulated design. In addition, it is contemplated that a plurality of cooling nozzles 54, 54' could be incorporated, as desired. Other configurations are likewise possible. It is, therefore, to be understood that within the scope of the appended claims, the invention may be practiced otherwise than as specifically described.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A piston (10, 10') for an internal combustion engine, comprising:

an upper crown portion (16, 16');

a lower crown portion (26, 26') joined to said upper crown portion;

an outer cooling gallery (31, 31') formed between said upper crown portion (16, 16') and said lower crown portion (26, 26');

an oil inlet (50, 50') communicating directly with said outer cooling gallery (31, 31') for conducting oil into said outer cooling gallery (31, 31');

an oil outlet (52, 52') spaced from said inlet (50, 50') and communicating directly with said outer cooling gallery (31, 31') for conducting oil out of said outer cooling gallery (31, 31'); and a cooling nozzle (54, 54') formed separately from said upper and lower crown portions and communicating directly with said outlet (52, 52') for conducting at least a portion of oil exiting said outer cooling gallery (31, 31') through said outlet (52, 52') and toward an under-crown surface (60, 60') of the piston.

2. The piston of claim 1, wherein said cooling nozzle (54, 54') comprises a generally tubular member.

3. The piston of claim 1, wherein said outer cooling gallery (31, 31') has a floor (48, 48'), said oil outlet (52, 52') is disposed in said floor (48, 48'); and wherein said cooling nozzle (54, 54') extends between one end (68, 68') adjoining said oil outlet (52, 52') and an opposite end (70, 70') is oriented for discharge toward said under-crown surface (60, 60').

4. The piston of claim 3, wherein said upper crown portion (16, 16') and said lower crown portion (26, 26') are joined together as a unitary piston body (12, 12') extending along a common central reciprocating axis (14, 14'); said opposite end (70, 70') of said generally tubular cooling nozzle (54, 54') directed generally toward said central reciprocating axis (14, 14').

5. The piston of claim 3, further including a coupling interconnection (69, 69') between said one end (68, 68') of said cooling nozzle (54, 54') and said floor (48, 48') of said outer cooling gallery (31, 31').

6. The piston of claim 1, further including a central cooling gallery (33) directly below at least a portion of said under-crown surface (60, 60').

7. The piston of claim 6, wherein said central cooling gallery (33) includes an inner gallery floor (32) having a central opening therein; said cooling nozzle (54, 54') extending into said central cooling gallery (33) through said central opening.

8. The piston of claim 7, wherein said central cooling gallery (33) includes an annular flange (34) separating said inner gallery floor (32) and said central opening.

9. The piston of claim 1, wherein said outer cooling gallery (31, 31') has a floor (48, 48'), an inner annular wall (22, 22', 28, 28'), an outer annular wall (24, 24', 30, 30'), and a ceiling; said under-crown surface (60, 60') being generally concentrically disposed with respect to said outer cooling gallery (31, 31'); a central opening generally concentrically disposed within said inner annular wall (22, 22', 28, 28'); said cooling nozzle (54, 54') extending through said central opening.

10. The piston of claim 1, wherein said lower crown portion (26, 26') includes a pair of spaced apart pin bosses (36, 38), said pin bosses (36, 38) having pin bores (40, 42) aligned with one another along a pin bore axis (44, 44').

11. The piston of claim 1, wherein said upper crown portion (16, 16') and said lower crown portion (26, 26') are each pre-formed as separate loose-piece members and subsequently joined together as a unitary piston body (12, 12') extending along a common central reciprocating axis (14, 14').

12. The piston of claim 1, further including a central cooling gallery (33) directly below said under-crown surface (60, 60') and generally concentrically disposed relative to said outer cooling gallery (31, 31'); an inner annular wall (22, 22', 28, 28') separating said central cooling gallery (33) and said outer cooling gallery (31, 31'); and a supplemental oil passage (66) extending through inner annular wall (22, 22', 28, 28') between said outer cooling gallery (31, 31') and said central cooling gallery (33).

13. The piston of claim 1, wherein said outer oil gallery (31, 31') is formed as an inclusion between said upper crown portion (16, 16') and said lower crown portion (26, 26').

14. The piston of claim 1, including an upper combustion wall (18, 18') having a generally annular recessed combustion bowl (20, 20').

15. A piston (10, 10') for a compression ignition internal combustion engine, comprising:

an upper crown portion (16, 16');

a lower crown portion (26, 26');

said upper crown portion (16, 16') and said lower crown portion (26, 26') each pre-formed as separate loose-piece members and subsequently joined together as a unitary piston body (12, 12') extending along a common central reciprocating axis (14, 14');

an outer oil gallery (31, 31') formed as an inclusion between said upper crown portion (16, 16') and said lower crown portion (26, 26'), said outer oil gallery (31, 31') having a floor (48, 48'), an inner annular wall (22, 22', 28, 28'), an outer annular wall (24, 24', 30, 30'), and a ceiling;

an oil inlet (50, 50') communicating directly with said outer oil gallery (31, 31') for conducting oil into said outer oil gallery (31, 31');

an oil outlet (52, 52') spaced from said inlet (50, 50') and communicating directly with said outer oil gallery (31, 31') for conducting oil out of said outer oil gallery (31, 31');

a generally tubular passive cooling nozzle (54, 54') having one end (68) communicating directly with said oil outlet (52, 52') for receiving oil from said outer oil gallery (31, 31') and conducting the oil toward an under-crown surface (60, 60') of the piston; said cooling nozzle (54, 54') including a coupling (69, 69') interconnecting an end (68) thereof to said floor (48, 48') of said outer cooling gallery (31, 31').

16. A method for cooling a reciprocating piston with oil in an internal combustion engine comprising the steps of:

providing a piston (10, 10') having an upper combustion wall (18, 18') against which combustion forces act, an internal outer oil gallery (31, 31'), and an under-crown (60, 60') directly below the upper combustion wall (18, 18') and generally concentrically disposed relative to the outer oil gallery (31, 31');

reciprocating the piston (10, 10') in the internal combustion engine generally along a central reciprocating axis (14, 14');

simultaneously with said reciprocating step, directing a flow of oil into the outer oil gallery (31, 31');

draining the oil from the outer oil gallery (31, 31') through an outlet (52, 52');

and channeling the oil drained from the outer oil gallery (31, 31') directly to the under-crown (60, 60') through a cooling nozzle (54, 54') in the form of a tubular member.

17. The method of claim 16, wherein said draining and channeling steps are directly responsive to said reciprocating step whereby reciprocating movement of the piston (10, 10') along the central reciprocating axis (14, 14') causes the oil to move through the cooling nozzle (54, 54').

18. The method of claim 16, wherein said channeling step includes discharging the cooling oil from an opposite end (70, 70') of the cooling nozzle (54, 54') along a vector generally directed to intercept the central reciprocating axis (14, 14').

19. The method of claim 16, wherein said step of providing a piston (10, 10') includes pre-forming an upper crown portion (16, 16') and a lower crown portion (26, 26') as separate loose-piece members and subsequently joining the upper (16, 16') and a lower (26, 26') crown portions together as a unitary piston body (12, 12').

20. The method of claim 16, wherein said step of subsequently joining the upper (16, 16') and a lower (26, 26') crown portions includes welding.

* * * * *